US009217301B1

(12) United States Patent
Latham

(10) Patent No.: US 9,217,301 B1
(45) Date of Patent: Dec. 22, 2015

(54) ATTACHABLE COLLAR FOR DOWN HOLE APPARATUS

(71) Applicant: William Garland Latham, Montrose, CO (US)

(72) Inventor: William Garland Latham, Montrose, CO (US)

(73) Assignee: B.O.N.D. ENTERPRISES, LLC, Montrose, CO (US)

( * ) Notice: Subject to any disclaimer, the term of this patent is extended or adjusted under 35 U.S.C. 154(b) by 338 days.

(21) Appl. No.: 13/785,129

(22) Filed: Mar. 5, 2013

Related U.S. Application Data

(60) Provisional application No. 61/607,130, filed on Mar. 6, 2012.

(51) Int. Cl.
*E21B 17/10* (2006.01)

(52) U.S. Cl.
CPC ..... *E21B 17/1078* (2013.01); *E21B 17/1085* (2013.01)

(58) Field of Classification Search
CPC E21B 17/1078; E21B 17/1085; E21B 17/105
See application file for complete search history.

(56) References Cited

U.S. PATENT DOCUMENTS

| | | | | |
|---|---|---|---|---|
| 3,067,593 | A | 12/1962 | McCool | |
| 3,447,839 | A * | 6/1969 | Salvatori | 175/325.4 |
| 4,379,494 | A * | 4/1983 | Sheshtawy | 175/325.2 |
| 4,549,613 | A * | 10/1985 | Case | 175/325.2 |
| 7,392,861 | B2 * | 7/2008 | Fouillou et al. | 175/325.1 |
| 7,395,883 | B2 * | 7/2008 | Beccu | 175/415 |
| 8,083,011 | B2 * | 12/2011 | Sreshta et al. | 175/325.2 |
| 8,733,455 | B2 * | 5/2014 | Shaikh et al. | 166/380 |
| 2006/0070731 | A1 * | 4/2006 | Fouillou et al. | 166/241.4 |
| 2007/0137899 | A1 * | 6/2007 | Beccu | 175/296 |
| 2010/0078222 | A1 * | 4/2010 | Sreshta et al. | 175/325.3 |
| 2011/0180273 | A1 | 7/2011 | Hughes et al. | |
| 2012/0125689 | A1 * | 5/2012 | Howlett | 175/57 |
| 2012/0255744 | A1 * | 10/2012 | Shaikh et al. | 166/380 |
| 2014/0000900 | A1 * | 1/2014 | Leiper et al. | 166/311 |
| 2014/0008127 | A1 * | 1/2014 | Plessis et al. | 175/55 |

FOREIGN PATENT DOCUMENTS

| | | | |
|---|---|---|---|
| CA | 2510932 | A1 * | 1/2006 |
| WO | WO 2013090971 | A1 * | 6/2013 |
| WO | WO 2014082183 | A1 * | 6/2014 |

* cited by examiner

*Primary Examiner* — Jennifer H Gay
(74) *Attorney, Agent, or Firm* — Henry L. Smith, Jr.

(57) ABSTRACT

An attachable collar arrangement for a down hole apparatus that includes a collar member releasably insertable into a cutaway section disposed circumferentially around a tool joint or other down hole apparatus. The collar member is stabilized in position within the cutaway section by means of a stabilizing insert member which is releasably inserted between at least two sections of the collar member, and removably secured into a member insert receptacle disposed upon the tool joint or other down hole apparatus. Wear and erosion are directed to the collar member during drilling operations and the tool joint or down hole apparatus is thereby protected. The collar member is expediently replaceable when needed and drilling operations are extended over the life of particular drilling equipment to which the device is installed.

11 Claims, 10 Drawing Sheets

ATTACHABLE COLLAR FOR DOWN HOLE APPARATUS

I claim the benefit of U.S. Provisional Application No. 61/607,130 filed on Mar. 6, 2012.

BACKGROUND OF THE INVENTION

Various types of protecting means for tool joints are known in the prior art. However, what is needed is an attachable collar for down hole apparatus that includes a cylindrical collar member releasably securable within a cutaway section disposed circumferentially inset upon a tool joint, or other down hole apparatus, wherein wear and erosion are directed to the collar member during operation, and said tool joint or other down hole apparatus is thereby protected, whereby the collar member is expediently replaceable when needed and drilling operations are extended.

FIELD OF THE INVENTION

The present invention relates to an attachable collar for down hole apparatus, and more particularly, to an attachable collar for down hole apparatus that includes a collar member releasably insertable into a cutaway section disposed circumferentially around a tool joint, or other down hole apparatus, said collar member stabilized in position within the cutaway seciton by means of a stabilizing insert member releasbly inserted between at least two sections of the collar member, said stabilizing insert member removably secured into a member insert receptacle disposed upon the tool joint, or other down hole apparatus, wherein wear and erosion are directed to the collar member during drilling operations and said tool joint or other down hole apparatus is thereby protected, whereby the collar member is expediently replaceable when needed and drilling operations are extended over the life of the particular drilling equipment to which the device is installed.

SUMMARY OF THE INVENTION

The general purpose of the attachable collar for down hole apparatus, described subsequently in greater detail, is to provide an attachable collar for down hole apparatus which has many novel features that result in an attachable collar for down hole apparatus which is not anticipated, rendered obvious, suggested, or even implied by prior art, either alone or in combination thereof.

The present invention is contemplated as a hard metal wear band stimulator for use when drilling substrate for oil, gas, water, or data, among other drilling and resource extractive operations, whether on land or at sea. However, the general scope of the invention is not considered limited by any particular material from which the device is manufactured, nor by the particular down hole operation to which the device is directed, said invention being appropriate for use in drill stands, mud motors, steering tools, subs, or any other down hole apparatus, upon the body of the apparatus in addition to use more specifically in tool joints. The present disclosure, therefore, should be considered applicable for all drilling operations and down hole applications wherein the present device may be useful in preventing wear to a particular tool joint or down hole apparatus to which the present device is installed.

During drilling operations, tool joints connecting drill pipe into a particular drill stand (or, as case may be, interconnecting other down hole equipment) are subject to increased wear, presenting a larger external diameter than the remaining drill pipe to which they are attached, whereby rotary motion of the drilling apparatus renders more frequent contact of the tool joints with the well annulus and each tool joint presents a enlarged surface against which drilling fluid, including borne sediment and drilling debris, is subjected. Thus, over time and repeated use, tool joints are regularly worn more rapidly than accompanying drill pipe and must be, therefore, more frequently replaced.

Present practice in the art is to weld a reinforcing annular bead upon each tool joint, thereby increasing the external diameter of said tool joint by addition of said bead, whereby said bead is eroded down previous to damage rendered upon the tool joint proper. This practice is moderately effective and convenient in the field as a particular tool joint can be reinforced when needed on site. However, the action of welding such an annular bead upon a particular tool joint inadvertently weakens said tool joint over time with repeated welds, whereby at length entire sections of a particular drill stand must be replaced. Such required drilling down time, transport of drill pipe to and from the well site, and purchase of new drill pipe, over time, represents a substantial cost incurred when drilling. The present invention substantially lessens this cost and, furthermore, is more expediently installable upon a tool joint than the reinforcing means presently practiced in the art.

What is needed, then, is an attachable collar for down hole apparatus having a replaceable collar member that is expediently installable upon a tool joint for increased wear protection of said tool joint over extended use while drilling. Said collar member must be easily installable and readily replaceable, whereby less time is wasted in replacing said collar member compared to welding a particular reinforcing bead (or other common practice in the art), and more time is effected down hole in active drilling before replacement of said collar member is necessitated.

It should be noted that although the preferred embodiment is considered for use with tool joints in a drill stand proper, the present invention contemplated is also usable upon the body of additional down hole apparatuses, when desired, and should not be considered limited for use with tool joints only, many such down hole apparatuses not requiring tool joints for operation. The general scope of the present teaching is therefore applicable in practice upon any part of any particular down hole apparatus to which an attachable collar may be effected, as desired.

The present attachable collar for down hole apparatus, therefore, includes a replaceable collar member readily installable upon a tool joint, said collar member fit to rotationally engage inside an annular cutaway section disposed circumferentially upon said tool joint of a relevant drill pipe. It should be noted that the term "tool joint" is taken herein to include any connection means disposed connecting two drill pipes into a drill stand (or interconnecting other down hole equipment, as case may be), said tool joint thereby disposed at each of the pin end and box end of any particular drill pipe that is interconnected with another such drill pipe. It should also be recognized that the number of collar members disposed per tool joint is contemplated to include multiple collar members disposed in corresponding multiple cutaway sections, but for ease of disclosure and clarity of portrayal in describing the metes and bounds of the present attachable collar for down hole apparatus, whereby one of ordinary skill in the art is enabled to practice the invention as devised, a single collar member only is presented herein attachable to a single cutaway section per tool joint. The device should not be considered limited by this single configuration of parts disposed per tool joint, as presented herein, but said configuration should be recognized as providing the necessary and complete disclosure of the invention's individual parts, independent of the number of such collar members and cutaway sections used per a particular tool joint connecting drill pipe into a relevant drill stand, by which a full understanding of the invention may be effected. Moreover, as will be readily ascertained in considering the general scope of the invention herein disclosed, the present attachable collar for down hole apparatus may readily be practiced upon any particular down hole apparatus, installed upon the body of said apparatus, and not restricted for use upon the tool joint only.

Therefore, the present attachable collar for down hole apparatus includes an annular cutaway section disposed circumferentially inset upon a relevant tool joint (or other down hole apparatus). A pair of retaining lips are disposed in parallel circumferentially bordering the cutaway section, each of said retaining lips disposed overhanging the cutaway section in a plane contiguous with the surface of the particular tool joint in which the device is disposed. The cylindrical collar member is cut into sections, and each section rotationally inserts into the cutaway section whereby each of a first and a second rim, disposed circumferentially upon the collar member, rotationally insert under each of the respective pair of retaining lips.

A cover receiving portion is inset upon the tool joint adjacent to, and contiguous with, the cutaway section. The cover receiving portion is disposed around only a portion of the tool joint, whereby a portion of one of the pair of retaining lips is interrupted. The cover receiving portion thus enables positioning of each section of the collar member into the cutaway section at the cover receiving portion whereby subsequent rotation of said section thence rotationally engages each of the first rim and second rim into position underlying each of the respective retaining lips.

In the preferred embodiment herein disclosed, the collar member is cut into three sections, each section occupying an arc corresponding to 120° of the circle formed when each of the three sections of the collar member is assembled. The cover receiving portion therefore lies around one-third of the circumference of the tool joint adjacent to, and contiguous with, the cutaway section. Each 120° section of the collar member is thus positional into the cutaway section at the cover receiving portion, and thence rotatable into position with each of the first and second rims slidingly engaged underlying each of the respective pair of retaining lips. However, it should be noted, additional or less sections are contemplated into which the collar member is cut, and the cover receiving portion is contemplated at a size and position able to accommodate the arc length described by each of said sections, as may be desired.

When installed upon the tool joint, and rotated into position within the cutaway section, a slot is maintained between at least two of the sections of the collar member. This slot is configured to releasably receive a stabilizing insert member therein, said stabilizing insert member sized to tightly fit within the slot between the at least two sections of the collar member, and there releasably secure within a member insert receptacle disposed inset upon the circumference of the tool joint underlying the collar member. The stabilizing insert member thus prevents rotation of the collar member about the tool joint, and anchors said collar member in position thereto.

An arcuate cover plate is disposed to insert into the cover receiving portion subsequent positioning of the collar member upon the tool joint. The cover plate is releasbaly securable within the cover receiving portion and overlies the first rim of the collar member there disposed, whereby the entire circumference of each of the first and second rims disposed upon the collar member is retained beneath each of the respective pair of retaining lips and the cover plate. In the preferred embodiment herein disclosed, the cover plate is disposed to cover an at least 60° of arc of two of the three sections comprising the collar member. The collar member is thus stabilized from removal from the cutaway section by attachment of the cover plate in position within the cover receiving portion disposed upon the tool joint. It should be noted that the cover plate is engineered to set flush into the tool joint to secure the collar member therein.

A sloped section is disposed circumferentially upon the collar member proximal the first rim, said sloped section disposed to face down hole when the collar member is installed upon a relevant tool joint and a drill stand is operated into an annulus. The sloped section directs drilling fluid along the sloped section gradient and around the collar member, thereby forcing drilling fluid, and any sediment or debris therein, over the collar member and away from the respective tool joint.

While smooth collar members are contemplated as part of this invention, the primary function of which is to direct wear away from the tool joint to which said collar member is attached, a collar member having at least one flute is presented herein. This fluted collar member includes at least one flute disposed angularly between the first rim and the second rim. Rotational action of the drill stand during drilling operation therefore forces drilling fluid through said at least one flute, directing drilling fluid into a vortex around the drill stand to maintain suspension of sediment, debris, and particles, within the drilling fluid until discharge. Said agitation of the drilling fluid, and suspension of sediment therein, prevents the settling of sediment along non-vertical sections of well bore, thereby preventing the build-up of sediment dams known in the art to subject relevant sections of drill stands turned thereover to stresses which can bend said sections of drill stand, increase wear and erosion during turning, and decrease torque at the bottom hole apparatus.

The present attachable collar for down hole apparatus therefore enables a more expedient means of preserving tool joints and associated drill pipe than present practices common in the art. The present attachable collar for down hole apparatus increases usable life of each section of drill pipe during extended drilling operations, and each collar member is more rapidly installable and, when required, expediently replaceable, than welding reinforcing beads or plates thereto.

Thus has been broadly outlined the more important features of the present attachable collar for down hole apparatus so that the detailed description thereof that follows may be better understood and in order that the present contribution to the art may be better appreciated.

Objects of the present attachable collar for down hole apparatus, along with various novel features that characterize the invention are particularly pointed out in the claims forming a part of this disclosure. For better understanding of the attachable collar for down hole apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
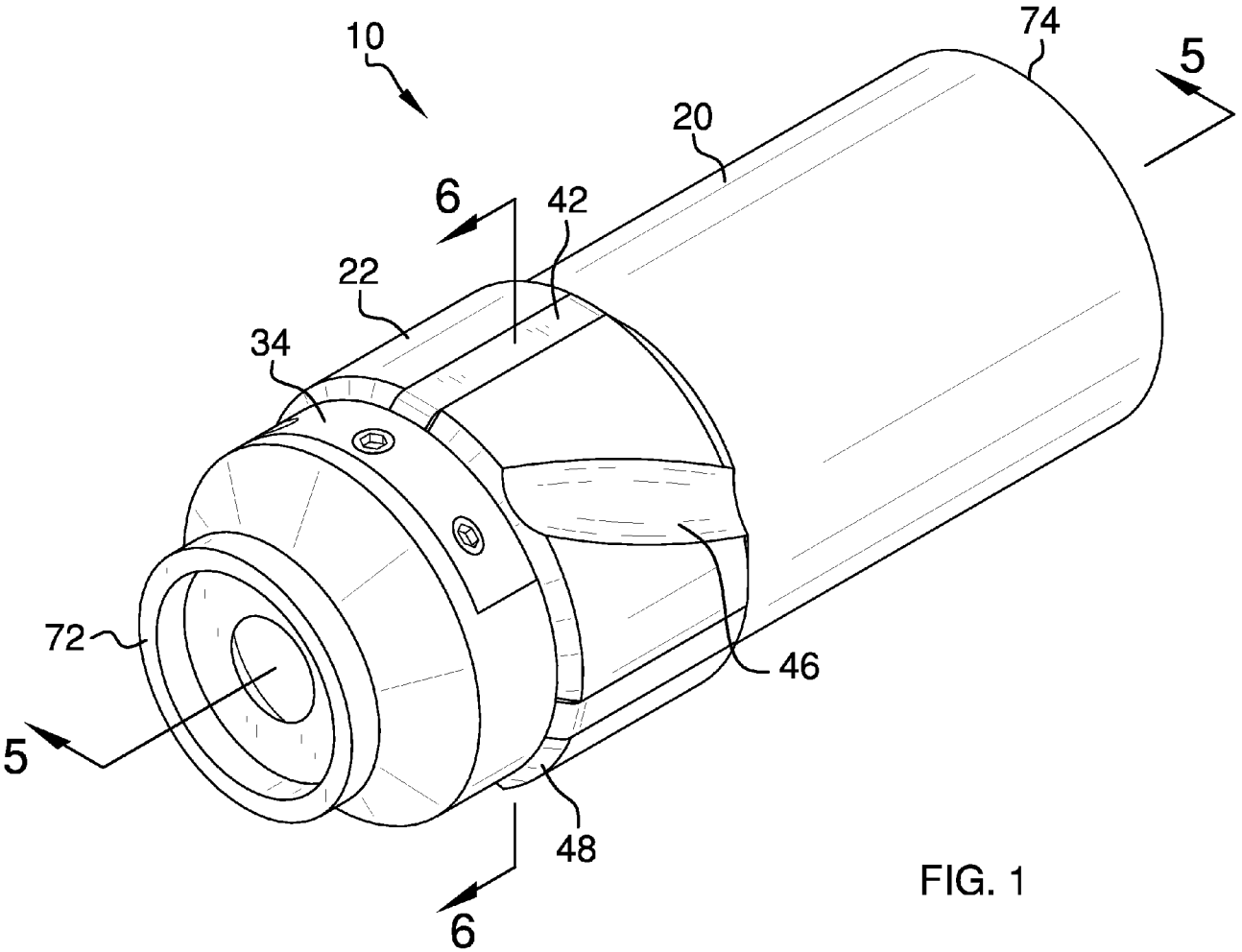
FIG. 1 is an isometric view.

With reference now to the drawings, and in particular FIGS. 1 through 10 thereof, example of the instant attachable collar for down hole apparatus employing the principles and concepts of the present attachable collar for down hole apparatus and generally designated by the reference number 10 will be described.

Referring to FIGS. 1 through 10 a preferred embodiment of the present attachable collar for down hole apparatus 10 is illustrated.

The present attachable collar for down hole apparatus 10 has been devised as a hard metal wear band stimulator for use upon drill stands 100 and includes an attachable collar member 22 that prevents wear to associated tool joints 20 during drilling. While the preferred embodiment is contemplated as a durable metal amendment to a tool joint 20 connecting drill pipe 70 into a desired drill stand 100, additional materials are contemplated as the device 10 is readily rendered of any durable material available. Thus the particular alloy, metal, substance, or material from which the instant attachable collar for down hole apparatus 10 is manufactured should not be considered a limitation of the device 10 presented herein.

The present attachable collar for down hole apparatus 10 is easily installable to a drill pipe 70 (or other down hole apparatus) and a collar member 22 is thereby readily replaceable, whereby associated tool joints 70 across an entire drill stand 100 are protected during extended use. The present device 10 may be used with multiple collar members 22 installed per tool joint 20, at both the pin end 72 and box end 74 of any particular drill pipe 70 comprising a desired drill stand 100, and the present invention 10 should not be considered limited to a single collar member 22 installed per tool joint 20 connecting drill pipe 70 in a particular drill stand 100. Nor should the present invention 10 be considered restricted for use with tool joints 70 only, but practicable upon any part of a desired down hole apparatus subject to increased wear during use. However, for ease of disclosure and apprehension of the device 10 herein disclosed, a single collar member 22 is disclosed installable per a tool joint 20 throughout this specification.

Figure 2:
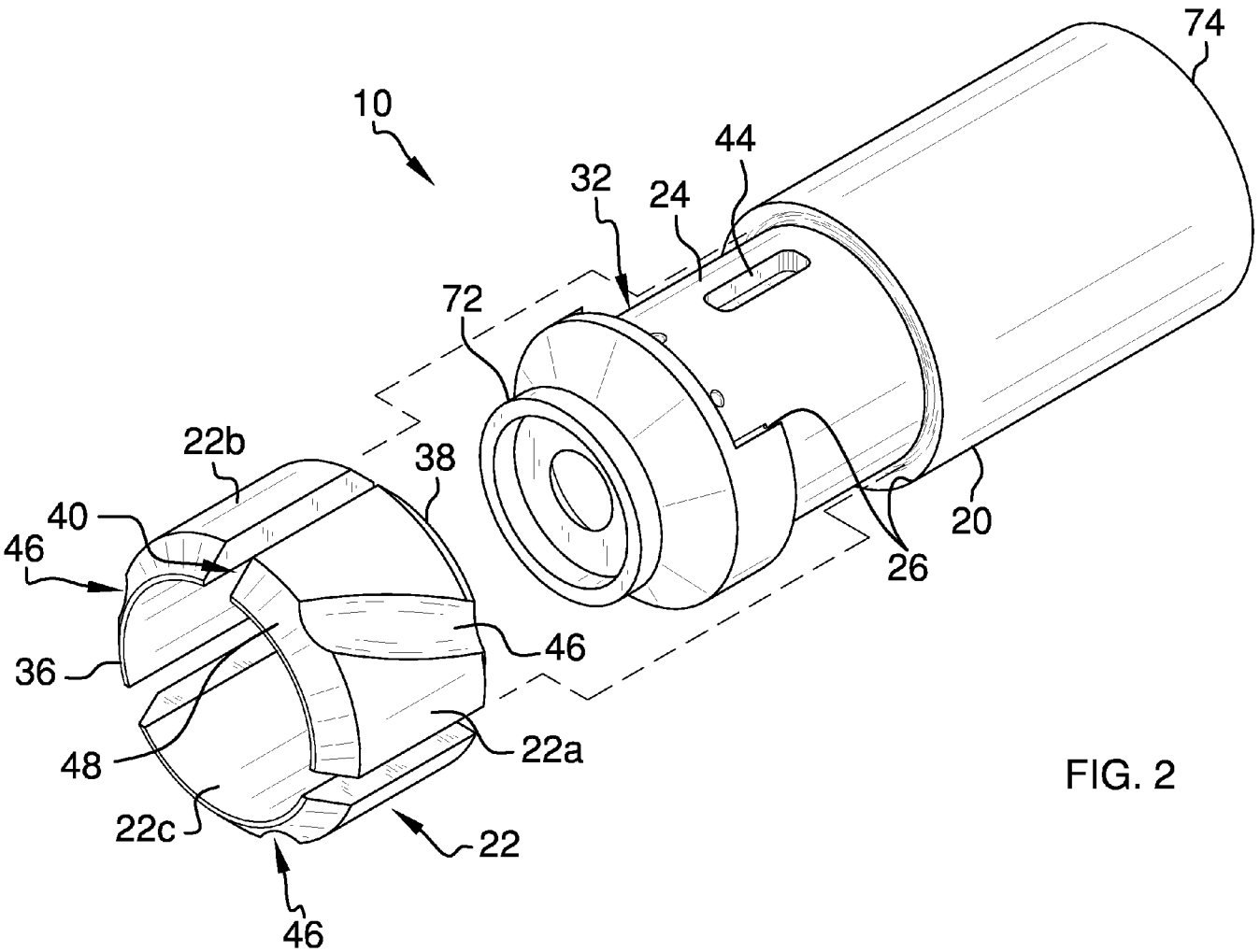
FIG. 2 is an isometric view with a collar member removed.
Figure 3:
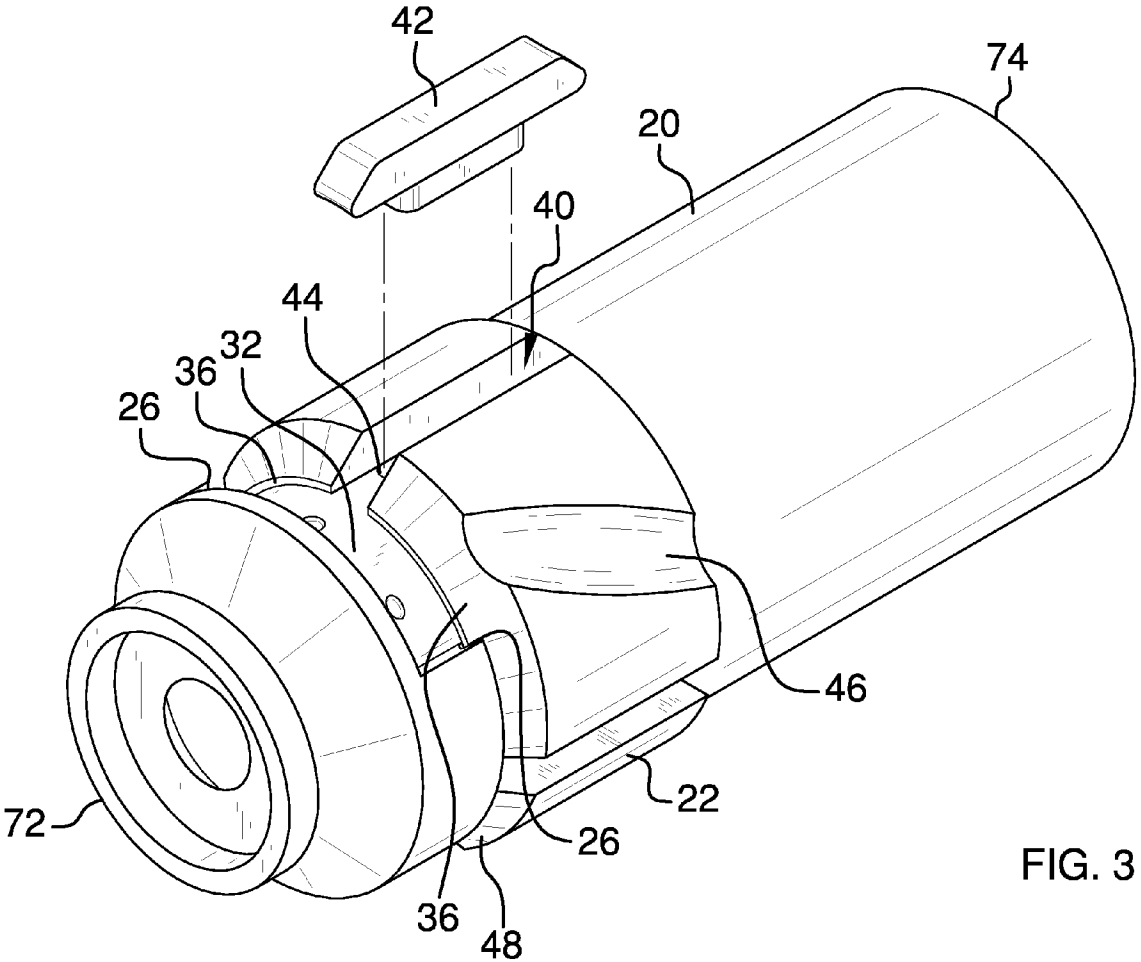
FIG. 3 is an isometric view illustrating securement of the collar member by insertion of a stabilizing insert member.
Figure 4:
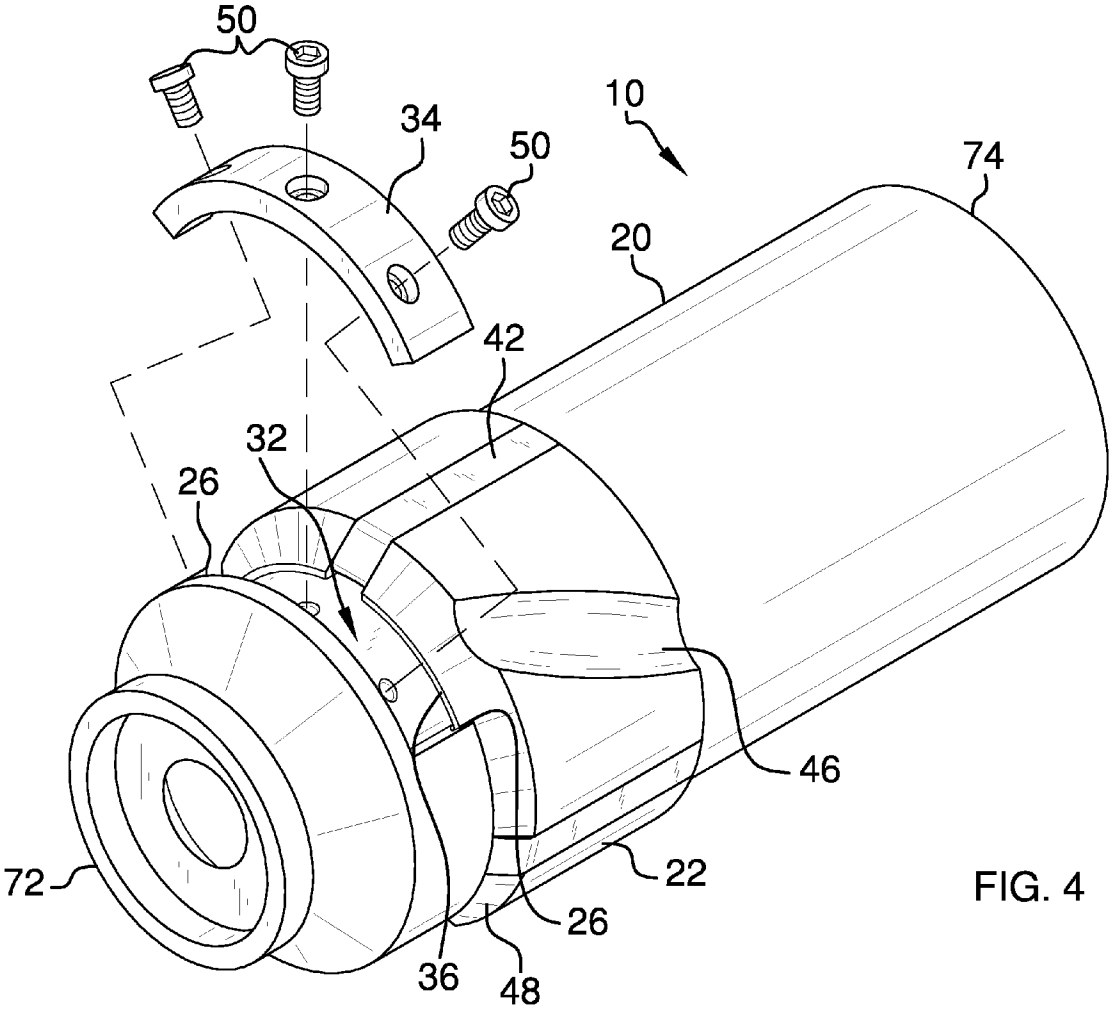
FIG. 4 is an isometric view detailing the installation of an arced cover plate into a cover receiving portion.
Figure 5:
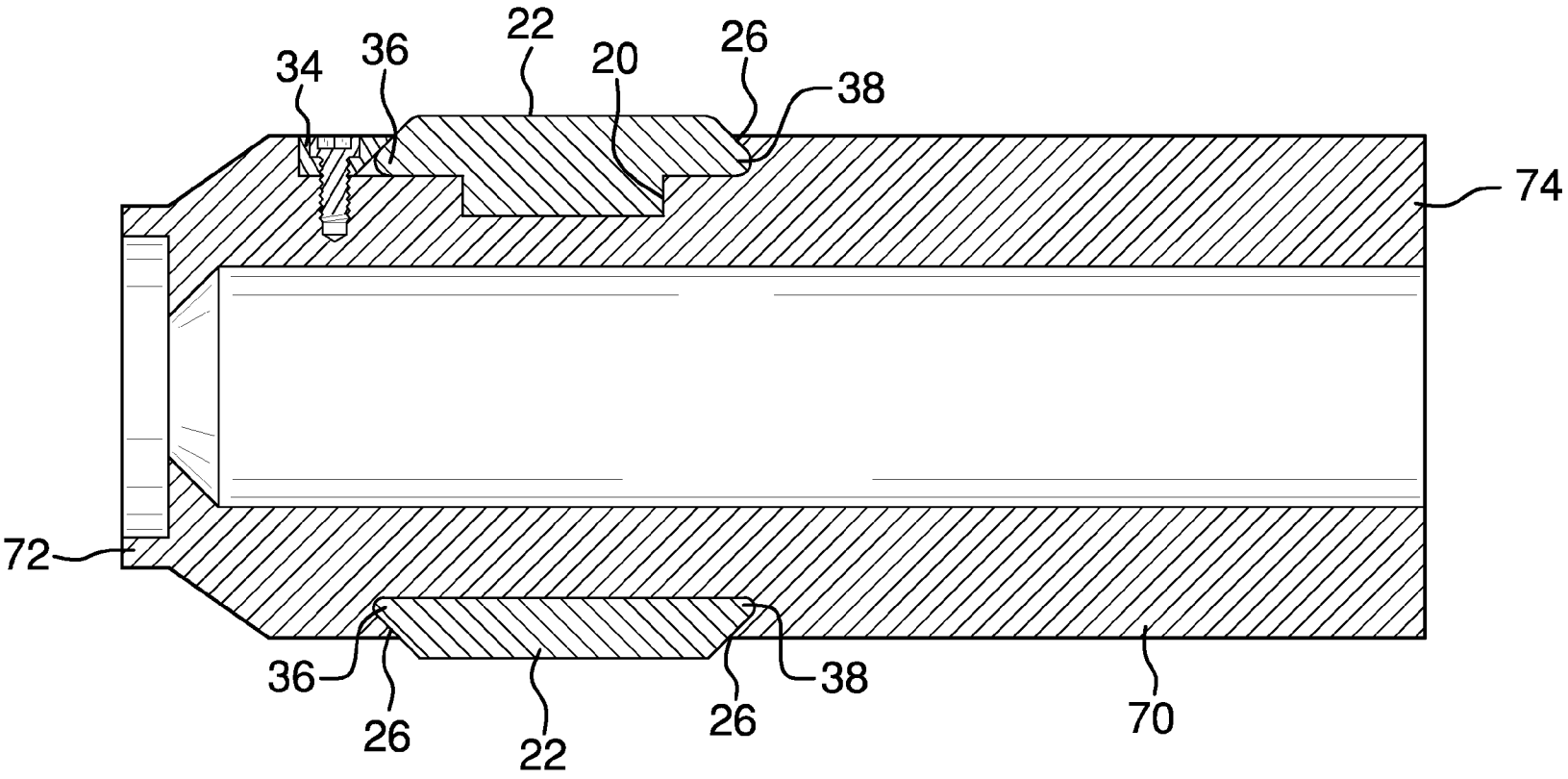
FIG. 5 is a longitudinal-section view taken along the line 5-5 of FIG. 1
Figure 6:
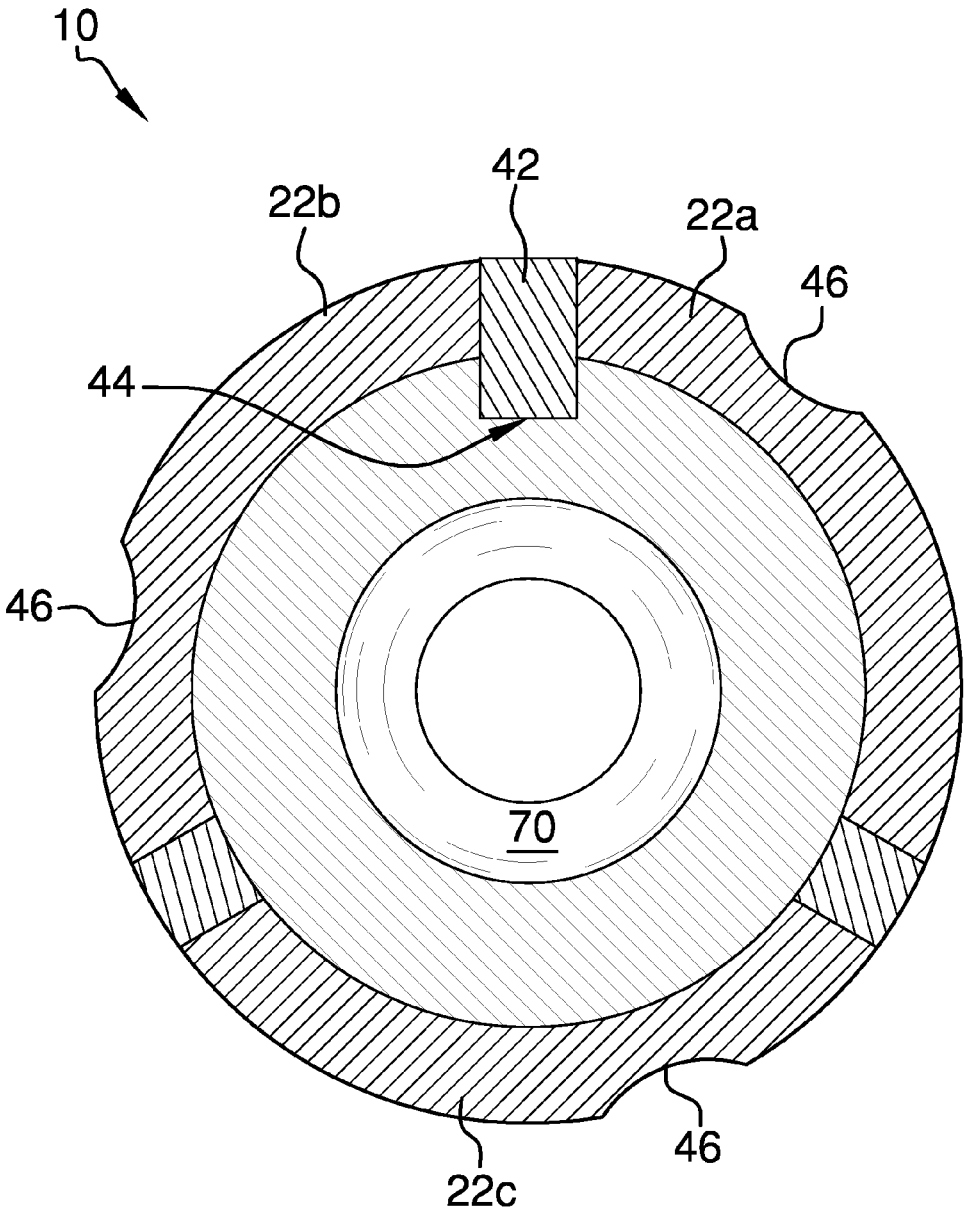
FIG. 6 is a transverse-section view taken along the line 6-6 of FIG. 1.

As shown in FIG. 2, the attachable collar for down hole apparatus 10, therefore, includes an annular cutaway section 24 disposed circumferentially upon the tool joint 20. The cutaway section 24 is sized appropriate to rotationally receive the collar member 22 therein. A pair of retaining lips 26 is disposed circumferentially around the tool joint 20, each of said pair of retaining lips 26 overhanging the cutaway section 24 in parallel in positions bordering the cutaway section 24. The collar member 22 is cylindrical and cut into sections (see below) and rotationally inserts into the cutaway section 24, therein positional with each of a first rim 36 and a second rim 38 disposed underlying each of the pair of retaining lips 26, as will be described subsequently.

A cover receiving portion 32 is likewise disposed inset upon the tool joint 20, parallel to and contiguous with the annular cutaway section 24. The cover receiving portion 32 is disposed contiguous with the cutaway section 24 and thus interrupts the continuity of one of the pair of retaining lips 26, thereby enabling positioning of sections of the attachable collar member 22 for installation upon the particular tool joint 20, as will be explained below. The cover receiving portion 32 also secures the collar member 22 in place within the cutaway section 24 when an arcuate cover plate 34 is releasably secured into the cover receiving portion 32 (see below). In the preferred embodiment herein disclosed, the cover receiving portion 32 is disposed adjacent to the cutaway section 24 along one third of the circumference of said cutaway section 24. However, other sizes of the cover receiving portion 32 are contemplated as part of the invention 10, as will be detailed subsequently.

Figure 7:
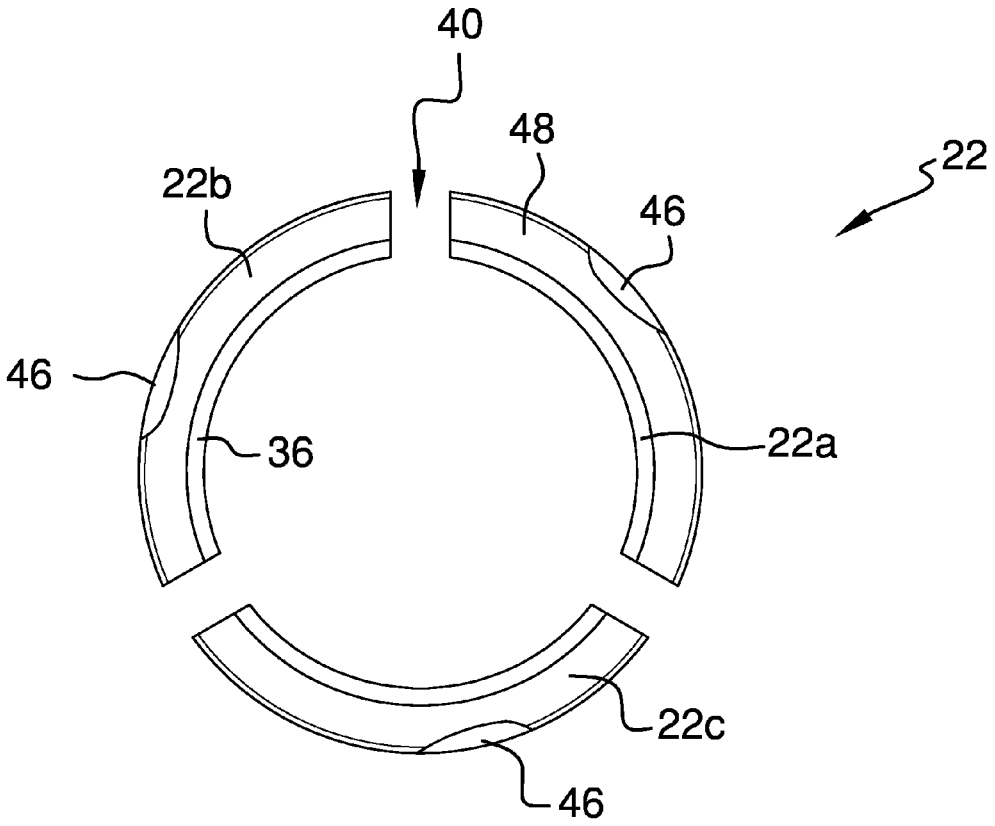
FIG. 7 is an isometric view of the collar member illustrating three sections cut at 120° increments around the circumference.
Figure 8:
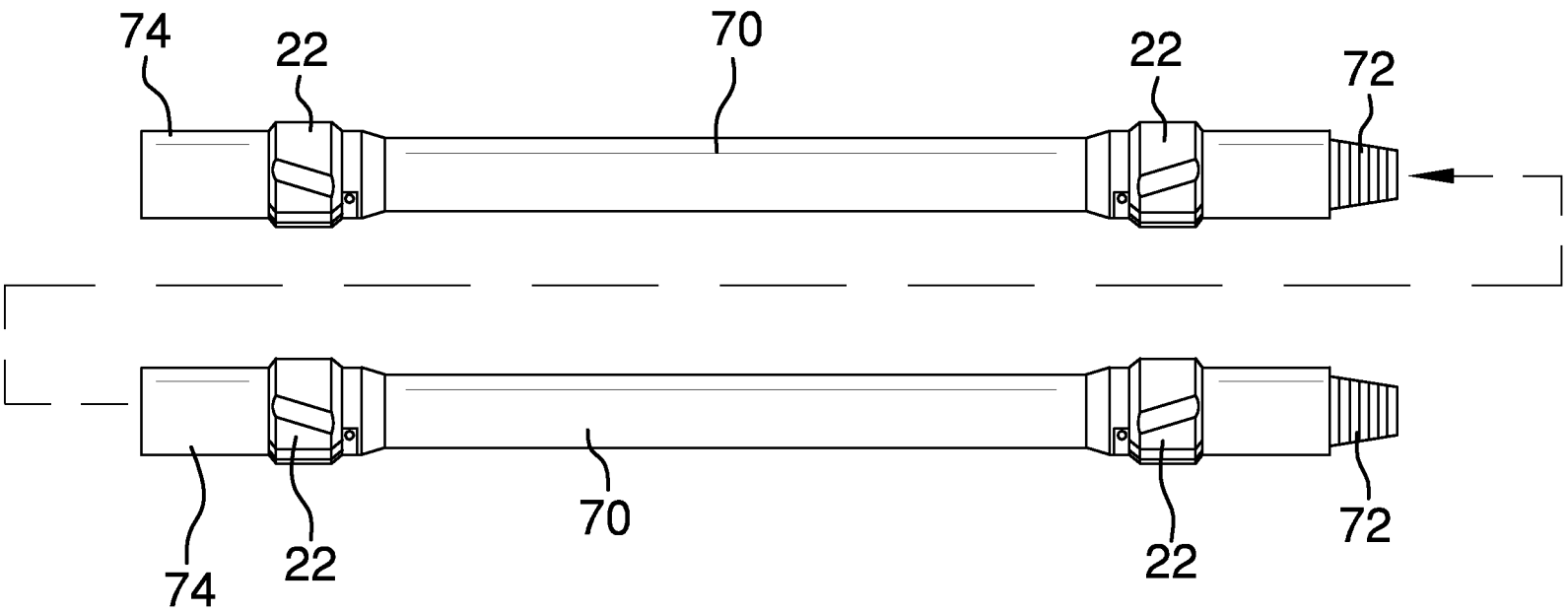
FIG. 8 is an in-use view of a drill stand to which the device is installed.

In the preferred embodiment herein presented, the replaceable, cylindrical collar member 22 is cut into three sections 22*a*, 22*b*, 22*c*, each of said sections rotationally insertable into the cutaway section 24 (see for example FIG. 7). It should be noted that more or less sections of the collar member 22 are contemplated as part of the invention 10, but that annular strength and ease of assembly enables the preferred embodiment herein disclosed as having three such sections, 22*a*, 22*b*, and 22*c*, each rendered at approximately 120° of arc around the circumference of the collar member 22. Each of these three sections 22*a*, 22*b*, 22*c*, is positional into the cutaway section 24 at the cover receiving portion 32, and then rotatable into the cutaway section 24 as will be described below.

A first rim 36 and a second rim 38 are disposed circumferentially bordering the cylindrical collar member 22. Each of said first and second rims 36 and 38 is therefore rotationally positional underlying each of the respective pair of retaining lips 26 when each section of the collar member 22 is inserted into the tool joint 20 at the cover receiving portion 32 and rotated into position within the cutaway section 24.

When appropriately positioned within the cutaway section 24, a slot 40 is maintained between at least two of the three sections 22*a*, 22*b*. The slot 40 is configured to releasably receive a stabilizing insert member 42 therein, said stabilizing insert member 42 sized appropriately to fit tightly within the collar member 22 slot 40 when the three sections 22*a*, 22*b*, 22*c*, are appropriately positioned within the cutaway section 24 (see FIG. 3). The stabilizing insert member 42 is releasably attachable in the slot 40, releasably engaging and securing into a member insert receptacle 44 disposed recessed upon the tool joint 20 underlying the collar member 22. The member insert receptacle 44 therefore releasably secures the stabilizing insert member 42 to the tool joint 20 when said stabilizing insert member 42 is inserted into the slot 40 of the collar member 22, said stabilizing insert member 42 thereby preventing rotation of the collar member 22 about the cutaway section 24.

To further secure the collar member 22 in position within the tool joint 20, the arcuate cover plate 34 is included (shown in FIG. 4), sized for removable securement within the cover receiving portion 32 subsequent positioning of said collar member 22 within the cutaway section 24. When installed into position within the cover receiving portion 32, the cover plate 34 is disposed with an outer surface disposed flush with the tool joint 20. The cover plate 34 thus releasably secures into the cover receiving portion 32 and overlies a portion of the first rim 36 of at least one of the sections 22*a*, 22*b*, 22*c*, of the collar member 22. In the preferred embodiment herein disclosed, fasteners 50 releasably secure the cover plate 34 in position.

It should be noted that attachment of the cover plate 34 overlying the first rim 36 of the collar member 22, when positioned within the cutaway section 24, assists in preventing rotational movement of the collar member 22 upon the tool joint 20, and that, further, the first rim 36 engaged under the corresponding retaining lip 26 proximal the cover plate 34 further prevents rotational movement of the collar member 22 when installed upon the relevant tool joint 20, whereby additional stabilizing means are contemplated as part of this invention 10.

Figure 9:
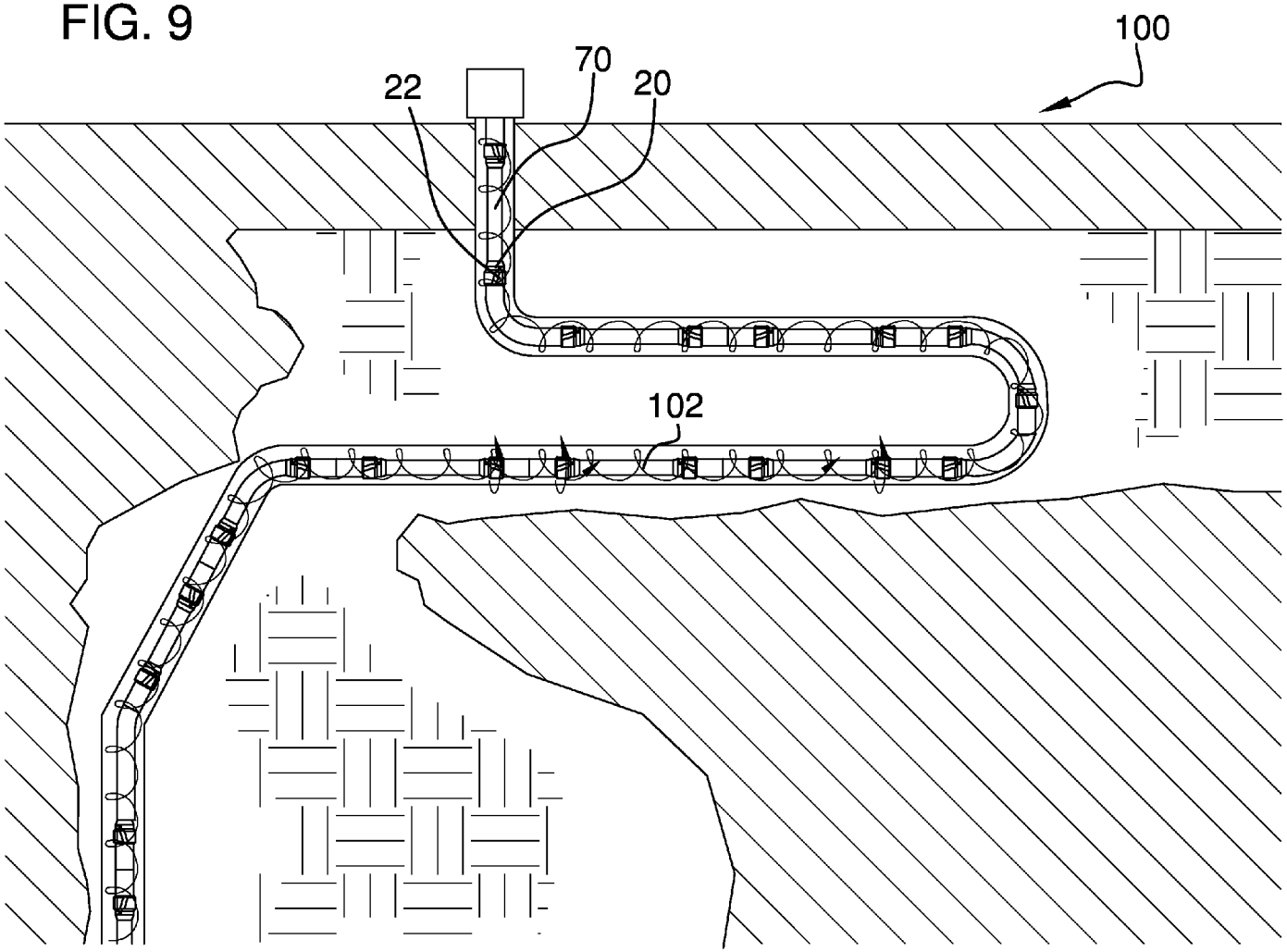
FIG. 9 is an in-use view of a drill stand to which the device is installed down well.
Figure 10:
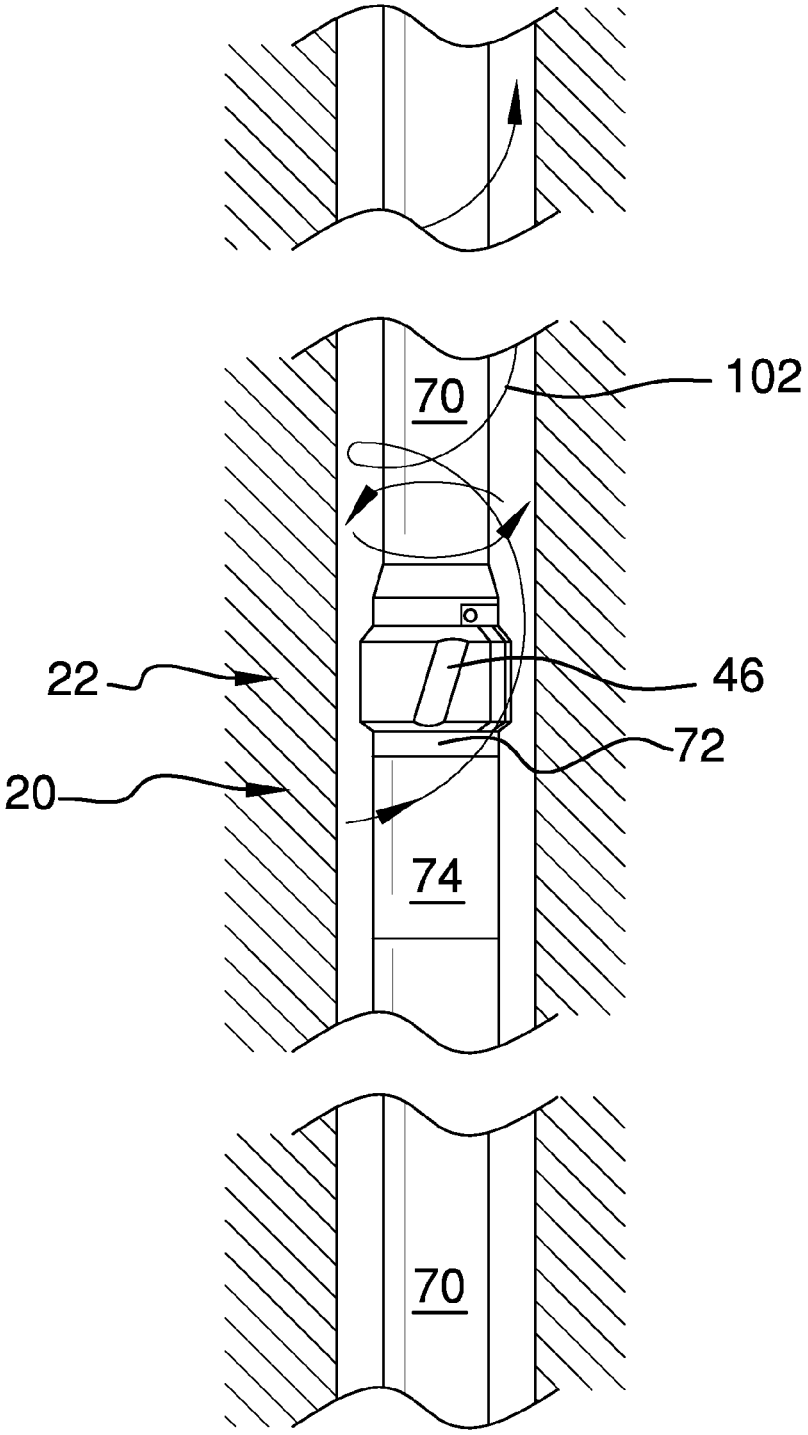
FIG. 10 is a detail view of at least one flute disposed on the collar member agitating drilling fluid in a vortex around a drill pipe.

While embodiments are contemplated having a cylindrical collar member 22 only, used merely for wear prevention upon a particular tool joint 20, the preferred embodiment herein disclosed includes at least one flute 46 disposed upon the collar member 22 (see, for example, FIG. 1). The flute 46 is positioned angularly between the first rim 36 and the second rim 38 and directionally engages drilling fluid 102 and debris forced up well through the drill hole annulus during drilling, wherein said drilling fluid is directed into a vortex around the drill stand 100 to prevent the settling of heavier sediments from said drilling fluid 102 along low-slope portions of a particular well bore or deviated well (see, for example, FIG. 9). This agitation of the drilling fluid, sediment, and debris forced up well, ensures such sediment remains suspended until discharge and prevents the build-up of dams underneath horizontal, low-slope, and non-vertical sections of any particular drill hole or deviated well (as shown in FIGS. 9 and 10). Said agitation of drilling fluid 102 prevents adverse action of such dams upon the drill stand 100, such action capable of bending drill pipe 70 turned thereover, increasing wear and erosion of associated drill stands 100, and lessening torque at the bottom hole assembly.

A sloped section 48 is disposed upon the replaceable collar member 22 surrounding the first rim 36, said sloped section 48 positioned to face down hole when the collar member 22 is installed upon a tool joint 20. Drilling fluid thereby moves over the collar member 22 up the gradient of the sloped section 48, concentrating wear upon the replaceable collar member 22 rather than the tool joint 20 to which said collar member 22 is attached. The collar member 22 has a larger external radius than the tool joint 20 to which said collar member 22 is attached, and erosion is directed across the collar member 22 overlying the tool joint 20, preventing erosion of the tool joint 20 itself, whereby the collar member 22 is readily replaced (when needed) and the tool joint 20 and associated drill pipe 70 is reused over an extended drilling lifespan than otherwise is possible absent the present attachable collar for down hole apparatus 10. Moreover, the attachable collar member 22 is contemplated to be manufacturable from metals or materials more durable than the drill pipe 70 to which said collar member 22 is attached, as may be desired, thereby increasing utility during extended drilling operations and preserving the particular tool joint 20 over longer intervals before required replacement of said collar member 22. Considering the variety of substrates through which any particular well may be bored, the present invention 10 contemplates collar members 22 adapted to resist substrates of differing mineralogy, density, geology, and composition, whereby desired durability is selectable for the particular job at hand.

What is claimed is:

1. An attachable collar arrangement for a down hole apparatus comprising:

an annular cutaway section disposed circumferentially upon a down hole apparatus;

a fluted cylindrical collar member cut into at least two sections and having at least two slots between the collar member sections, said fluted collar member rotationally insertable into the cutaway section;

a stabilizing insert member sized to fit into at least one fluted collar member slot when the at least two sections of the collar member are positioned within the cutaway section; and a stabilizing insert member receptacle disposed upon the down hole apparatus, said member insert receptacle disposed underlying the fluted collar member to releasably secure the stabilizing insert member to the down hole apparatus when said stabilizing insert member is inserted into the at least one slot of the fluted collar member; and securing means attachable to the down hole apparatus, said securing means securing said collar member in position within the cutaway section;

wherein said collar member is readily installable and expediently replaceable upon said down hole apparatus, whereby said down hole apparatus is protected from wear during down hole operations.

2. The attachable collar arrangement for a down hole apparatus of claim 1 further comprising a cover receiving portion disposed upon the down hole apparatus adjacent to and contiguous with the annular cutaway section.

3. The attachable collar arrangement for a down hole apparatus of claim 2 further comprising a pair of retaining lips disposed circumferentially around the down hole apparatus, each of said pair of retaining lips overhanging the annular cutaway section, wherein each section of the collar member is rotationally inserted under said pair of retaining lips when placed into the down hole apparatus at the cover receiving portion and there rotated around the axis of the down hole apparatus.

4. The attachable collar arrangement for a down hole apparatus of claim 3 wherein each section of the collar member further comprises a first rim and a second rim, each of said rims rotationally positional underlying each of the pair of retaining lips when each section of the collar member is inserted into the down hole apparatus at the cover receiving portion and there rotated into position within the cutaway section.

5. The attachable collar arrangement for a down hole apparatus of claim 4 wherein the collar member further comprises a slot disposed between at least two of the sections of the collar member when said sections are rotationally positioned within the cutaway section.

6. The attachable collar arrangement for a down hole apparatus of claim 5 further comprising a stabilizing insert member sized to fit into the slot, wherein the collar member is stabilized within the cutaway section.

7. The attachable collar arrangement for a down hole apparatus of claim 6 further comprising a member insert receptacle disposed upon the down hole apparatus, said member insert receptacle disposed underlying the fluted collar member to releasably secure the stabilizing insert member to the down hole apparatus when said stabilizing insert member is inserted into the slot of the collar member.

8. The attachable collar arrangement for a down hole apparatus of claim 7 further comprising an arcuate cover plate sized for securement within the cover receiving portion subsequent positioning of the collar member within the cutaway section, whereby the collar member is releasably secureable in the cutaway section.

9. The attachable collar arrangement for a down hole apparatus of claim 8 wherein the collar member further comprises a sloped section surrounding the first rim, said sloped section positioned to face down hole when the collar member is installed on the down hole apparatus, whereby drilling fluid moves over the collar member up the gradient of the sloped section.

10. The attachable collar arrangement for a down hole apparatus of claim 9 further comprising at least one flute disposed upon the collar member, said flute positioned angularly between the first rim and the second rim to directionally engage drilling fluid forced through the drill hole annulus during drilling, wherein said drilling fluid is forced into a vortex around the down hole apparatus to prevent settling of heavier sediments from said drilling fluid, whereby said sediment remains in suspension until discharge.

11. An attachable collar arrangement for a down hole apparatus, including a tool joint, for connecting at least two sections of a down hole apparatus, said attachable collar arrangement for a down hole apparatus comprising:

an annular cutaway section disposed circumferentially upon the tool joint;

a pair of retaining lips disposed circumferentially around the tool joint, each of said pair of retaining lips overhanging the cutaway section in parallel;

a cover receiving portion disposed upon the tool joint contiguous with the annular cutaway section along about one third of the circumference of said cutaway section;

a replaceable cylindrical fluted collar member cut into three sections, each of said sections rotationally insertable into the cutaway section, said fluted collar member comprising:

a first rim and a second rim, each of said rims rotationally positional underlying each of the pair of retaining lips when each section of the fluted collar member is inserted into the tool joint at the cover receiving portion and rotated into position in the cutaway section;

a slot disposed between two of the three sections when said sections are rotationally positioned within the cutaway section;

at least one flute disposed upon the fluted collar member, said flute positioned angularly between the first rim and the second rim to directionally engage drilling fluid forced through the drill hole annulus during drilling, wherein said drilling fluid is forced into a vortex around the drill stand preventing settling of heavier sediments from said drilling fluid whereby said drilling fluid is agitated and sediment remains suspended until discharge;

a sloped section surrounding the first rim, said sloped section positioned to face down hole when the fluted collar member is installed on a tool joint, whereby drilling fluid moves over the fluted collar member up the gradient of the sloped section;

an arced cover plate sized for securement within the cover receiving portion subsequent positioning of the fluted collar member within the cutaway section, said cover plate releasably securable overlying a portion of the first rim of at least one of the sections of the fluted collar member;

a stabilizing insert member sized to fit into the fluted collar member slot when the three sections are positioned within the cutaway section; and a member insert receptacle disposed upon the tool joint, said member insert receptacle disposed underlying the fluted collar member to releasably secure the stabilizing insert member to the tool joint when said stabilizing insert member is inserted into the slot of the fluted collar member; wherein drilling fluid forced up well is agitated into a vortex around the drill stand during drilling and the replaceable fluted collar member prevents wear to the tool joint.

* * * * *